US007172350B2

(12) United States Patent
Chung

(10) Patent No.: US 7,172,350 B2
(45) Date of Patent: Feb. 6, 2007

(54) FORMING METHOD USING THERMAL TRANSFER PRINTING SHEET

(75) Inventor: Sook Hee Chung, Suwon-si (KR)

(73) Assignee: Korea Chemical Co., Ltd., Kyongki-Do (KR)

( * ) Notice: Subject to any disclaimer, the term of this patent is extended or adjusted under 35 U.S.C. 154(b) by 365 days.

(21) Appl. No.: 10/634,230

(22) Filed: Aug. 5, 2003

(65) Prior Publication Data

US 2004/0137143 A1 Jul. 15, 2004

(30) Foreign Application Priority Data

Jan. 9, 2003 (KR) ..... 10-2003-0001389

(51) Int. Cl.

| | |
|---|---|
| ***B41M 3/00*** | (2006.01) |
| ***B41M 7/00*** | (2006.01) |
| ***B44C 1/00*** | (2006.01) |
| ***B44C 1/22*** | (2006.01) |

(52) U.S. Cl. ..... 400/120.01; 101/483; 101/487; 101/491

(58) Field of Classification Search ..... None
See application file for complete search history.

(56) References Cited

U.S. PATENT DOCUMENTS

| | | | | |
|---|---|---|---|---|
| 4,824,437 A | | 4/1989 | Gregory | 8/471 |
| 4,871,407 A | * | 10/1989 | Honma et al. | 156/83 |
| 5,300,475 A | | 4/1994 | Takuma et al. | 503/227 |
| 6,228,508 B1 | | 5/2001 | Kassanits et al. | 428/547 |

FOREIGN PATENT DOCUMENTS

| | | | |
|---|---|---|---|
| JP | 53017414 A | * | 2/1978 |
| JP | 59185634 A | * | 10/1984 |
| JP | 63009533 A | * | 1/1988 |

* cited by examiner

*Primary Examiner*—Daniel J. Colilla
(74) *Attorney, Agent, or Firm*—Merchant & Gould P.C.

(57) ABSTRACT

The present invention relates to a forming method using a thermal transfer printing sheet which is capable of implementing a three dimensional pattern. A method of forming a protruded surface using a thermal conduction difference of each portion of the pattern by a partial deposition thermal transfer printing sheet printed on a surface of a base material of a plastic substrate, or a gold or silver thin film partially printed by an engraving roller, and then the printed surface is heated to a certain temperature, so that the surface is divided into a heat blocked portion and a heat absorbed portion. In the forming method using a partial deposition thermal transfer printing sheet, or a gold or silver thermal transfer printing sheet, a thermal transfer printing sheet is dry-printed using only a heat and pressure, and a protruded surface is easily formed through a thermal diffusion process. It is possible to form various natural protruded surfaces. A work process is simple, and an excellent three dimensional pattern and economical product is obtained.

14 Claims, 5 Drawing Sheets

FORMING METHOD USING THERMAL TRANSFER PRINTING SHEET

BACKGROUND OF THE INVENTION

1. Field of the Invention

The present invention relates to a forming method using a thermal transfer printing sheet. The printing sheet is capable of fabricating a product having a protruded surface formed by a thermal conduction difference of each portion. A partial deposition thermal transfer printing sheet is printed on a surface of a base material of a plastic substrate, or a gold or silver thin film is partially printed on a plastic substrate by an engraving roller, and then the printed surface is heated to a certain temperature, so that the surface is divided into a heat blocked portion and a heat absorbed portion.

2. Description of the Background Art

Generally, in a process line that fabricates picture frames or building interior materials using a transfer printing film, a thermal transfer printing sheet is printed on a corresponding object in the conventional art, and heat is applied to the surface. Thereafter, a n engraving roll on which a desired pattern is carved is pressurized for a certain period, so that a protruded pattern is implemented on a surface of an object in the same shape as the pattern engraved on the engraving roll.

However, in a method in which a protruded pattern is formed on a printed surface using an engraving roll after a thermal transfer printing is performed, an engraving roll having a corresponding engraved pattern is additionally fabricated based on a size and pattern of a base material on which a pattern is formed. The fabrication cost of a patterned product is increased.

In addition, in the product which has a protruded pattern effect using an engraving roll, the pattern is divided into a protruded portion and a depressed portion, so that a boundary therebetween is not clear. In addition, a finished product fabricated using an engraving roll has a simple pattern in a protruded surface due to a limited shape of an engraving roll by which a certain pattern is formed, and it is impossible to implement various natural patterns in a protruded surface. Therefore, in a conventional pattern forming method using an engraving roll, there is a limit for forming various patterns.

SUMMARY OF THE INVENTION

Accordingly, it is an object of the present invention to overcome the problems encountered in the conventional art.

It is another object of the present invention to provide a forming method using a thermal transfer printing sheet which is capable of implementing various natural 3D patterns by forming various protruded surfaces using a partial thermal blocking effect.

It is further another object of the present invention to provide a forming method using a thermal transfer printing sheet which is capable of implementing a simple and efficient fabrication process and decreasing a fabrication cost of a product in such a manner that a 3D protruded pattern surface is simply formed using only a heating apparatus.

To achieve the above objects, there is provided a forming method using a thermal transfer printing sheet, comprising the steps of a step (S100) for forming a base material 10 using a resin, a step (S300) for printing a thermal transfer printing sheet 21 to form a conduction film 24 on a surface of the formed base material 10, wherein the conduction film 24 includes a metallic conduction film 20 and an ink conduction film 22, or partially printing a gold or silver thermal transfer printing sheet 21 on a surface of said substrate, a step (S400) for heating a surface of the printed base material 10 and depressing the ink conduction film 22 on the base material 10 and a part of the base material 10 underneath the ink conduction film 22 by thermal diffusion, and a step (S500) for cooling the base material 10.

In addition, the forming method using a thermal transfer printing sheet further includes a step for transferring the formed base material. At this time, the step (S300) is implemented by an interfacing with the transfer of the base material.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The forming method using a thermal transfer printing sheet according to the present invention will be described.

First, a partial deposition thermal transfer printing sheet disclosed in an embodiment of the present invention refers to a metallic layer that is partially formed on a thermal transfer printing target member in such a manner that a metallic layer is partially deposited on a thermal transfer printing sheet for printing on a thermal transfer printing target member. A partial transfer printing of a gold or silver thermal transfer printing sheet refers to a gold or silver layer on a gold or silver thermal transfer printing sheet that is partially printed on a transfer printing target member.

In the present invention, in order for a printed metallic conduction film to be partially formed on a base material, a transfer printing is performed using a partial deposition thermal transfer printing sheet, or a gold or silver thermal transfer printing sheet, partially printed using an engraving roller. Thereafter, when a heat is applied to a surface of a base material on which a printed conduction film is formed, a part of a base material on which a metallic conduction film is printed, is blocked from heat, and the other portions of a base member in which a metallic conduction film is not printed, are not blocked from heat. The portions of the base material in which the heat is not blocked are depressed by melting thereby forming a protruded surface.

Figure 1:
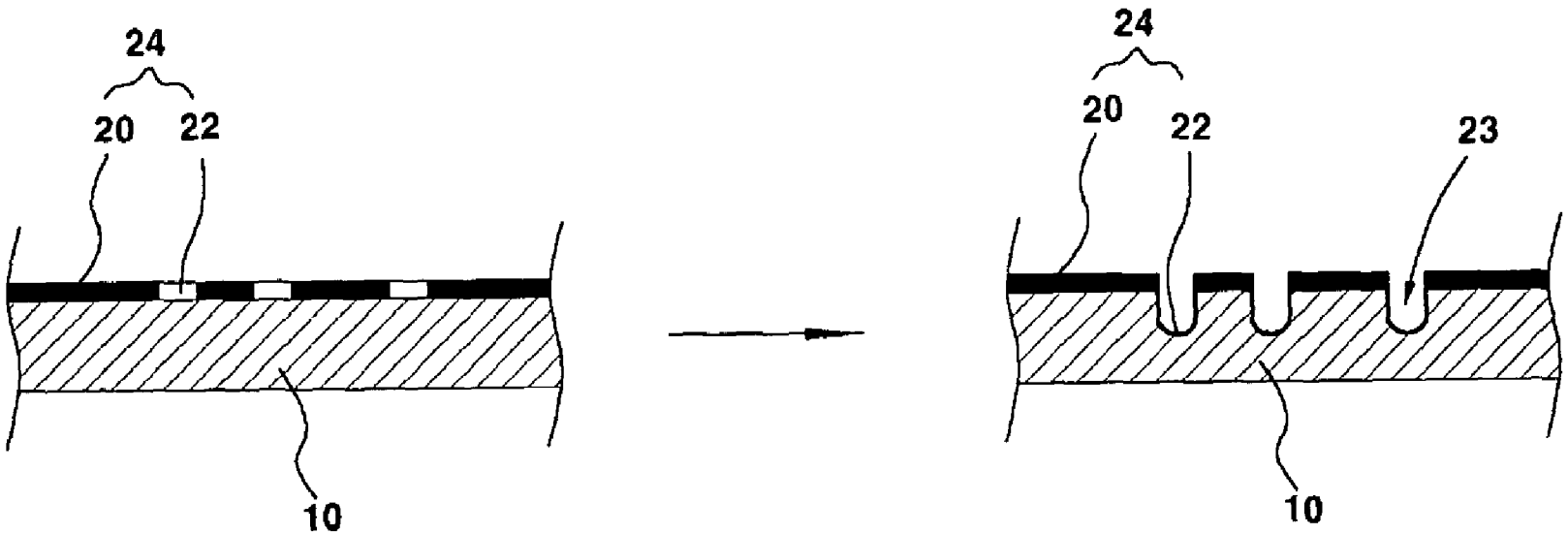
FIG. 1 is a cross sectional view schematically illustrating the construction before and after a thermal melting of a base material in which a thermal film is formed according to an embodiment of the present invention.

FIG. 1 is a cross sectional view schematically illustrating the construction before and after a thermal melting of a base material in which a thermal film is formed according to an embodiment of the present invention.

As shown in FIG. 1, when a conduction film 24 printed on a surface of a base material 10 by a thermal transfer printing sheet 21 is heated, an ink conduction film 22 among the printed conduction film 24 is thermally melted together with the base material 10 for thereby forming a depressed portion 23. The part in which heat is not applied is protruded, so that a protruded surface is formed. Here, an ink of the ink conduction film 22 is filled in the depressed portion 23. The ink may be further coated thereon.

Figure 2:
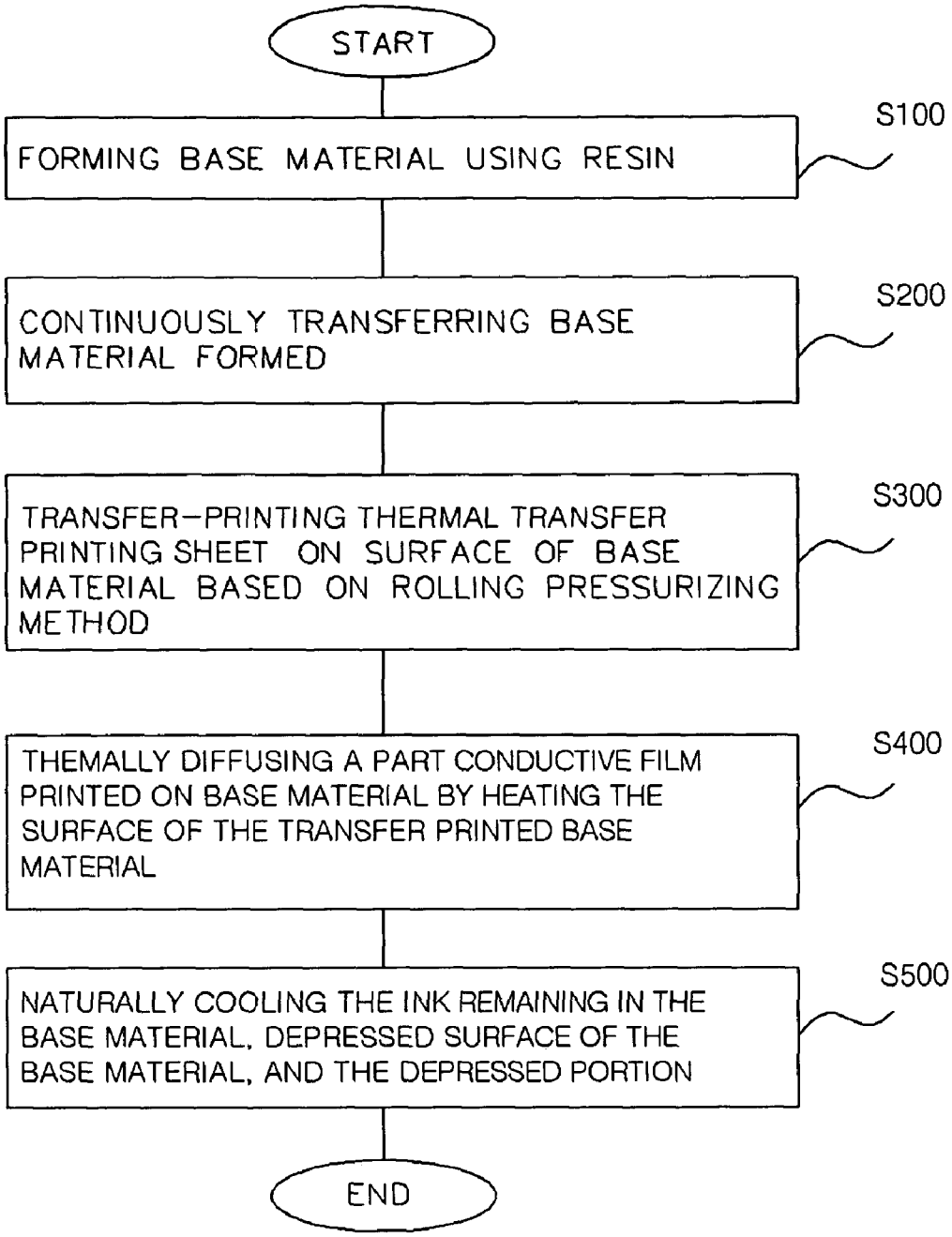
FIG. 2 is a flow chart illustrating a forming method using a thermal transfer printing sheet according to an embodiment of the present invention.
Figure 3:
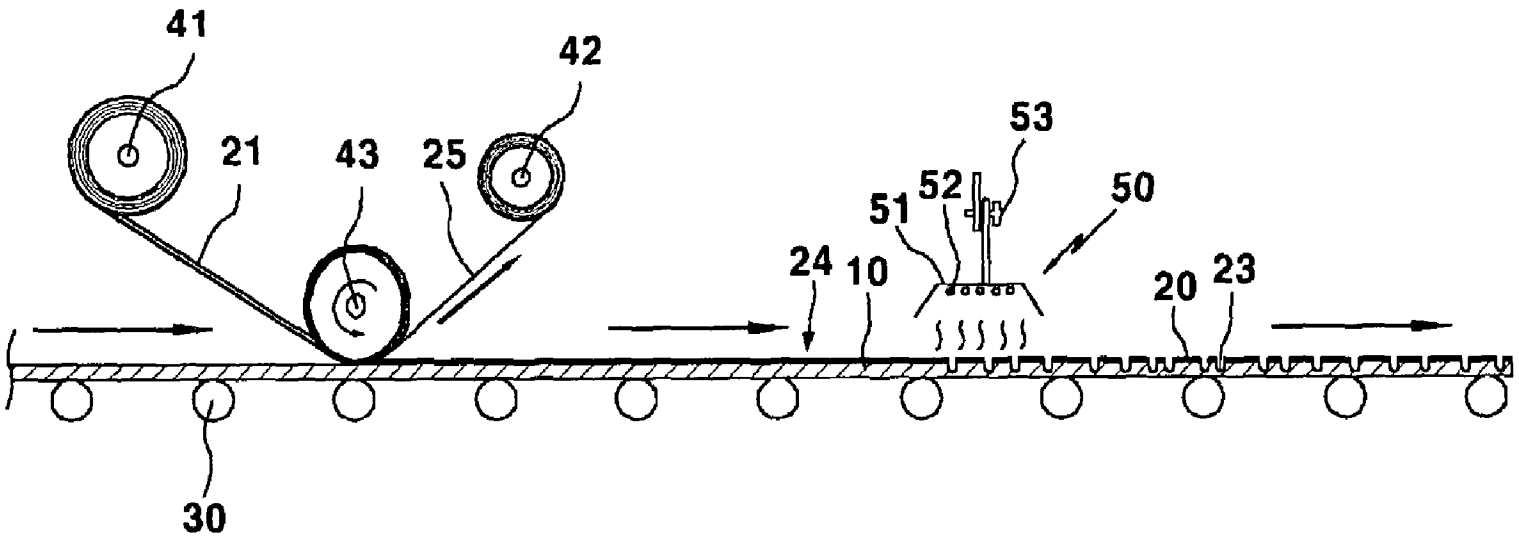
FIG. 3 is a view illustrating a schematic process diagram concerning a forming method using a thermal transfer printing sheet according to an embodiment of the present invention.

FIG. 2 is a flow chart illustrating a forming method using a thermal transfer printing sheet according to an embodiment of the present invention. FIG. 3 is a view illustrating a schematic process diagram concerning a forming method using a thermal transfer printing sheet 21 according to an embodiment of the present invention.

In the forming method using the thermal transfer printing sheet 21 according to an embodiment of the present invention, there are provided a feeding unit for feeding the base material 10 to enable a continuous process in the form of a conveyor, a transfer printing unit for printing the thermal transfer printing sheet 21 on the base material 10, a synthetic rubber roll or engraving roll 43 for dry-adhesion of the thermal transfer printing sheet 21, and a heating unit that provides heat to the transfer conduction film 24 to the finished base material 10.

As shown in FIGS. 2 and 3, in the forming method using the thermal transfer printing sheet 21 according to the present invention, a base material 10 is formed using a resin (S100).

In order to form the base material 10, a polystyrene in a plastic series resin or a resin of a polyvinylchloride series is inputted into an extruder as a source material, and the inputted source material is heat-melted to a temperature of 130~200° C. Thereafter, the base material 10 is extruded in various shapes such as a rod shape, a forming form or a plate shape. FIG. 3 shows a plate type base material according to an example of the present invention.

As a source material of the base material 10, an ABS or HIPS may be used instead of a resin of a polystyrene or polyvinylchloride series.

The size and length of the base material 10 may be determined based on the amount of inputted source material. A certain coloring agent or dye agent may be used for implementing a desired color. A foaming agent may be provided for implementing a strength adjustment.

Next, the formed base material 10 is printed (S200). The formed base material 10 is placed on a conveyor 30 and is continuously printed.

The partial deposition thermal transfer printing sheet 21 is printed on a surface of the base material 10 by partially transferring the base material, or the gold or silver thermal transfer printing sheet 21, thereon (S300).

The thermal transfer printing sheet 21 is continuously printed on a surface of the base material 10 based on an interfacing with a feeding speed of the base material 10. The printing operation is performed based on a dry diffusion transfer printing method in which a certain pressure and heat are provided. Namely, when a first roller 41 is rotated, the surface of the thermal transfer printing sheet 21 contacts with the base material 10, and a pressure of about 100~300 kg/m$^2$ is vertically applied by the roller 43 at a temperature of 130~200° C. Therefore, a stacked conduction film of the thermal transfer printing sheet 21 is printed on a surface of the base material 10. After the printing is performed, the film 25 remaining after removal of the stacked conduction film from the thermal transfer printing sheet 21 is continuously rolled onto a second roller 42.

In the case that the partial deposition thermal transfer printing sheet is used, a pressurizing rubber roller is used for the roller 43, and in the case that the gold or silver thermal transfer printing sheet is used, the engraving roller is used.

A metallic conduction film 20 is partially formed on the film 25 of the thermal transfer printing sheet 21. An ink conduction film 22 having a certain color is formed partially. The thusly formed pattern corresponds to a pattern formed on the partial deposition thermal transfer printing sheet 21, or a pattern formed in such a manner that the gold or silver conduction layer of the gold or silver thermal transfer printing sheet 21, is partially formed on the base material 10.

The above pattern may be formed in various shapes. For example, there are a simply repeated geometric pattern for example a check pattern, water drop pattern, etc., a character pattern for example, Korean, English, Chinese character, etc., a graphic for example a circular shape, triangle shape, rectangular shape, straight line shape, etc., an image for example a tree, person, landscape, abstraction, Korean type painting, oriental painting, etc., and a combination of the above.

The surface of the printed base material 10 is heated, and the ink conduction film 22 and a part of the base material 10 underneath the ink conduction film 22 are depressed by the thermal melting method (S400).

The heating unit 50 installed on the conveyor 30 is used for a heating device.

FIG. 4 is an example view illustrating the heating unit of FIG. 3.

As shown in FIG. 4, the heating unit 50 is freely movable and is installed in an outer side of the conveyor. The heating unit 50 includes a heat reflection plate 51 for enhancing a heating performance and a heat radiating filament 52 installed in an inner side of the heat reflection plate 51. The printing completed base material 10 which is continuously transferred by the conveyor 30 is heated to a temperature of about 130~200° C.

The time of heating by the heating unit 50 is about 3~5 seconds. At this time, since the heat is blocked from the metallic conduction film 20 among the printed conduction film 24, and the part of the base material 10 underneath the metallic conduction film 20 maintains an original shape. Since the heat is not blocked to the ink conduction film 22 among the printed conduction film 24, the ink conduction film 22 and the part of the base material 10 underneath the ink conduction film 22 are heat-melted for thereby forming a depression portion 23. A certain protruded surface corresponding to the pattern of the partial deposition thermal transfer printing sheet 21, or the pattern that the gold or silver thermal transfer printing sheet 21 partially printed using the engraving roller is formed in the base material 10 based on a difference between the heated and melted portion and the non-melted portion.

At this time, a certain color of the ink conduction film 22, for example, a white color, blue color, gold color, silver color, etc., is printed on the depressed portion 23 for thereby implementing a 3D pattern which has various colors.

In addition, the heating unit 50 is positioned in a portion straightly distanced by about 5~15 cm from the heat transfer printing sheet 21. This straight line distance may be adjusted based on the pattern of the base material and the kinds of the plastic material which forms the base material 10.

Figure 4A:
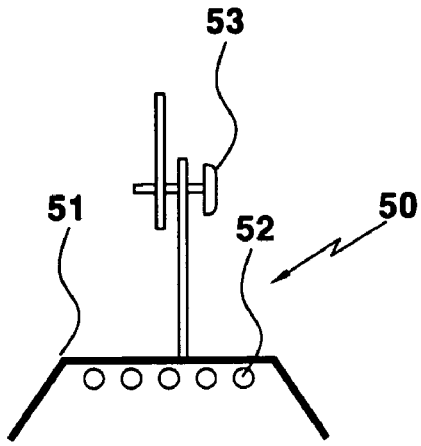
FIG. 4A is a schematic example view illustrating a plan model of a heater of FIG. 3.
Figure 4B:
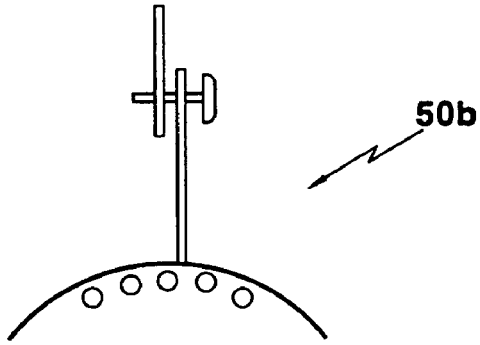
FIG. 4B is a schematic example view illustrating a concave model of a heater of FIG. 3.
Figure 4C:
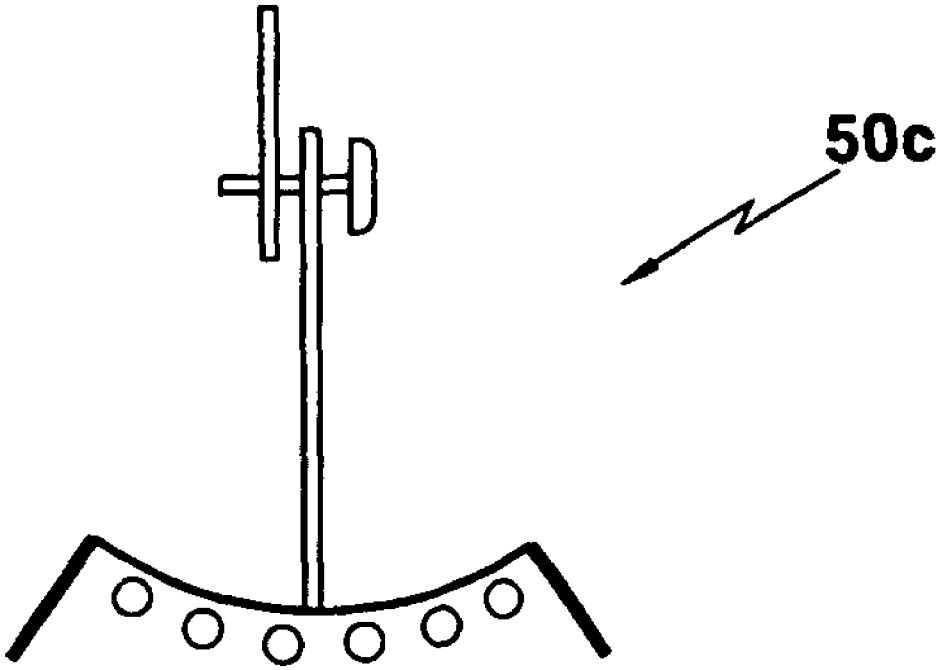
FIG. 4C is a schematic example view illustrating a convex model of a heater of FIG. 3.

FIG. 4A is a schematic example view illustrating a plan model of a heater of FIG. 3, FIG. 4B is a schematic example view illustrating a concave model of a heater of FIG. 3, and FIG. 4C is a schematic example view illustrating a convex model of a heater of FIG. 3.

As shown in FIGS. 4A, 4B and 4C, the heating unit 50 may be modified into various constructions. For example, the heating unit 50 may be classified into a plane type 50*a*, a concave type 50*b*, and a convex type 50*c*. The above type may be selected based on the type of the base material 10.

Therefore, the heating unit 50 may be freely selected based on the size of the base material 10, the surface type of the printed conduction film 24 such as the plane surface, concave surface, convex surface, etc. or the depth of the protruded surface.

In addition, a distance adjusting screw 53 is provided in the other side of each heating unit 50 for adjusting the interval between the printing completed base material 10 and the heating unit 50 for thereby freely adjusting the heating temperature and the heating area.

Finally, as the base material 10 is cooled, the three dimensional surface pattern is obtained using the thermal transfer printing sheet 21 (S500).

The base material 10 having a protruded surface is continuously transferred by the conveyor 30. Here, the base material 10, the surface of the depressed portion 23 of the base material 10, and the ink remaining in the depressed portion 23 are naturally dried, but a certain unit for cooling the same may be additionally provided.

As described above, in the forming method using the partial thermal transfer printing sheet 21 of the gold or silver thermal transfer printing sheet 21 is easily capable of forming a surface with prominence and depression through the thermal melting process after the thermal transfer printing sheet 21 is dry-printed using only the heat and pressure. In addition, it is possible to implement various natural protruded surfaces. The process is simplified. The formed three dimensional pattern is excellent. A desired economical advantage is obtained. In addition, in the present invention, it is possible to form various natural three dimensional patterns without any limit in the size of the base material or the construction of the engraving roll.

As the present invention may be embodied in several forms without departing form the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A forming method using a thermal transfer printing sheet, comprising the steps of:

a step (S100) for forming a base material (10) using a resin;

a step (S300) for printing a thermal transfer printing sheet (21) to form a conduction film (24) on a surface of the formed base material (10), wherein the conduction film (24) includes a metallic conduction film (20) and an ink conduction film (22);

a step (S400) for heating a surface of the printed base material (10) and depressing the ink conduction film (22) on the base material (10) and a part of the base material (10) underneath the ink conduction film (22) by thermal diffusion; and a step (S500) for cooling the base material (10).

2. The method of claim 1, wherein said step (S100) is implemented using a resin of a polystyrene series or a resin of a polyvinylchloride series as a source material of the base material.

3. The method of claim 1, wherein in said step (S300), the thermal transfer printing sheet (21) is printed on the base material (10) based on a dry diffusion method.

4. The method of claim 1, wherein in said step (S400), a surface of the base material (10) is heated to a temperature of 130~200° C.

5. The method of claim 1, further comprising a step (S200) in which the formed base material (10) is transferred.

6. The method of claim 5, wherein said step (S100) is implemented using a resin of a polystyrene series or a resin of a polyvinylchloride series as a source material of the base material.

7. The method of claim 5, wherein in said step (S200), the base material (10) is continuously transferred by a conveyor.

8. The method of claim 5, wherein in said step (S300), the thermal transfer printing sheet (21) is printed on the base material (10) based on a dry diffusion method.

9. The method of claim 5, wherein said step (S300) is implemented based on an interworking with the transfer of the base material (10).

10. The method of claim 5, wherein said step (S300) is implemented using a resin of a polystyrene series or a resin of a polyvinylchloride series as a source material of the base material.

11. The method of claim 10, wherein in said step (S200), the base material (10) is continuously transferred by a conveyor.

12. The method of claim 10, wherein in said step (S300), the thermal transfer printing sheet (21) is printed on the base material (10) based on a dry diffusion method.

13. The method of claim 10, wherein in said step (S400), a surface of the base material (10) is heated to a temperature of 130~200° C.

14. The method of claim 1 wherein the thermal transfer printing sheet is a gold or silver thermal transfer printing sheet.

* * * * *